US007510326B2

(12) United States Patent
Chen

(10) Patent No.: US 7,510,326 B2
(45) Date of Patent: Mar. 31, 2009

(54) MOISTURE-PROOF SEALING BAG

(75) Inventor: Han-Lung Chen, Taipei Hsien (TW)

(73) Assignee: Highland Champ Corporation, Tortola (VG)

( * ) Notice: Subject to any disclaimer, the term of this patent is extended or adjusted under 35 U.S.C. 154(b) by 667 days.

(21) Appl. No.: 11/182,764

(22) Filed: Jul. 18, 2005

(65) Prior Publication Data

US 2007/0014492 A1 Jan. 18, 2007

(51) Int. Cl.

| | |
|---|---|
| ***B65D 33/01*** | (2006.01) |
| ***B65D 81/20*** | (2006.01) |
| ***B65B 31/04*** | (2006.01) |
| ***F16K 15/00*** | (2006.01) |

(52) U.S. Cl. ..... 383/103; 206/524.8; 141/65; 137/543.19

(58) Field of Classification Search ..... 383/103; 137/543.19; 206/524.8; 141/65; 426/118
See application file for complete search history.

(56) References Cited

U.S. PATENT DOCUMENTS

| | | | | |
|---|---|---|---|---|
| 939,987 | A * | 11/1909 | Dawley | 137/543.19 |
| 2,754,844 | A * | 7/1956 | Blackford | 137/514 |
| 3,799,427 | A * | 3/1974 | Goglio | 383/103 |
| 5,354,133 | A * | 10/1994 | Rapparini | 383/103 |
| 6,056,439 | A * | 5/2000 | Graham | 383/103 |
| 2005/0190995 | A1 * | 9/2005 | Koyanagi | 383/103 |

* cited by examiner

*Primary Examiner*—Jes F Pascua
(74) *Attorney, Agent, or Firm*—Lowe Hauptman Ham & Berner, LLP

(57) ABSTRACT

A moisture-proof sealing bag comprises a bag body and an exhausting valve. The bag body has an opening, which has a flexible belt on the opening end. A proper position under the flexible belt of the bag body has the exhausting valve. The exhausting valve is concealed inner the bag body, which comprises a valve body, an exhausting unit, a valve gate and an elastomer. The moisture-proof sealing bag has functions of moisture-proof and air-tightness so as to preserve the contents in the bag by use of sealing the opening of the bag with the flexible belt and exhausting the residual air with the exhausting valve.

7 Claims, 6 Drawing Sheets

MOISTURE-PROOF SEALING BAG

BACKGROUND OF THE INVENTION (a) Field of the Invention

The present invention relates to a moisture-proof sealing bag, and in particular a moisture-proof bag for containing materials or commodities to prevent from moisture and increase airtight effect of the bag.

(b) Description of the Prior Art

Prior arts of bags are used for containing commodities, such as food products, food materials, dog-foods, chemical materials or plastic materials etc. After the bags are opened, it is difficult for a user to surely seal the bags, which causes the residual air to stay in the bags. Thus, the smells of the contents of the bags may be leaked out to pollute air qualities of the surroundings. Besides, the residual air in the bags with moisture may deteriorate the contents of the bags.

A structure of a prior art of an exhausting valve usually comprises double elements, which are upper and down valves. The down valve element is pasted on the inner the bag body, and then installed with the upper valve element outside the bag body. Both the upper and down valves are clipped each other firmly on the bag body. The prior art is higher cost, because of too many units for manufacture and complicated structures. Furthermore, for the sake of the weak point of the structural design, when the exhausting valve is combined with the bag body, the upper valve will be exposed out the bag body, which may increase the volume of the bag body and cause the possibility of wear and tear.

SUMMARY OF THE INVENTION

The primary objective of the present invention is to provide a wet-proof sealing bag for containing commodities. The wet-proof sealing bag can be used conveniently to open and seal it repeatedly. Besides, a vacuum cleaner can be applied to inhale the residual air in the bag through the exhausting valve. Then the wet-proof sealing bag forms a status of vacuum so as to downsize the volume of the bag and prevent from moisture to deteriorate the contents in the bag.

The second objective of the present invention is to provide a wet-proof sealing bag for concealing the exhausting valve inner the bag body. The appearance of the bag body is smooth without any raised piece so as to downsize the volume of the bag body and avoid the tear and wear by touching.

The third objective of the present invention is to provide a wet-proof sealing bag for sealing the opening effectively so as to avoid the smell of the contents in the bags leaking out and reducing air qualities of the surroundings.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
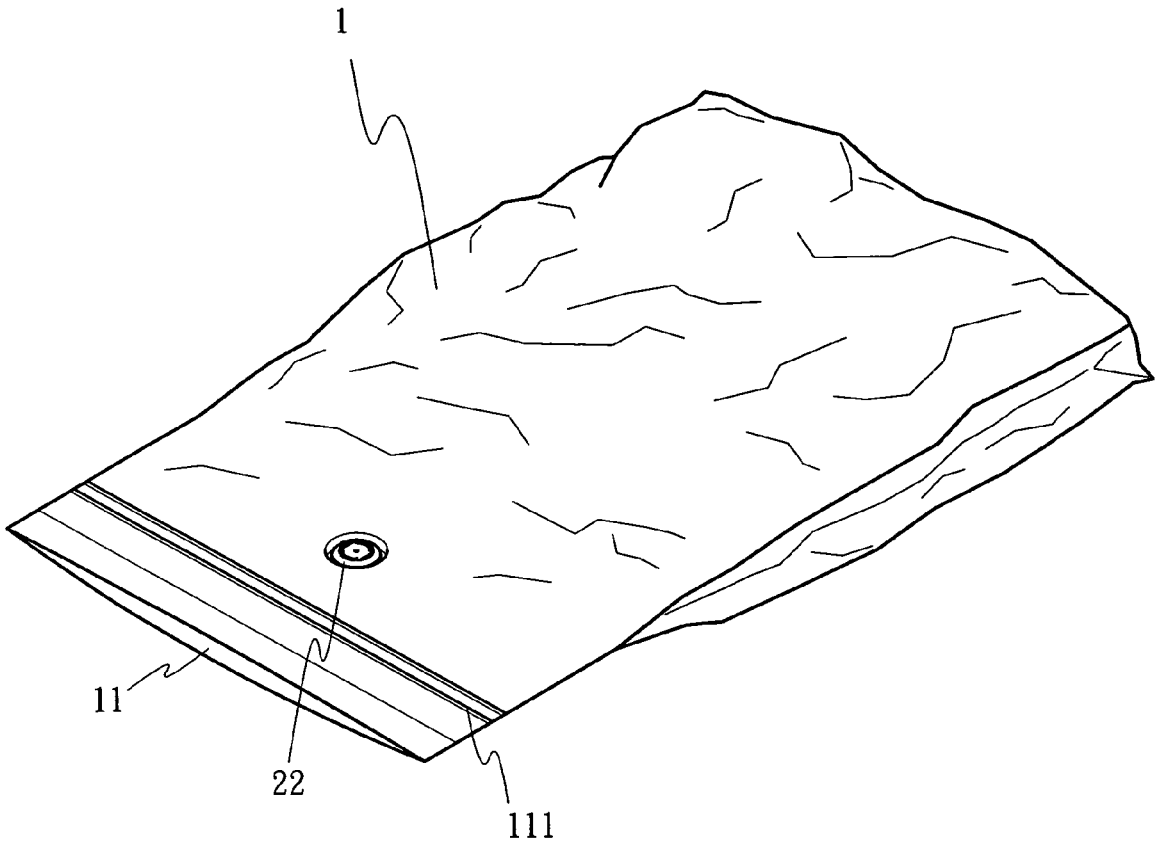
FIG. 1 is an appearance perspective view of the wet-proof sealing bag of the present invention.

Referring to FIG. 1, a moisture-proof sealing bag of the present invention is illustrated. The present invention includes a bag body 1 and an exhausting valve 2.

The bag body 1 is made at least one of Nylon, polyeater, polyethylence, aluminum, or paper. The bag body 1 has a single layer or a plurality of layers. The bag body 1 has an opening 11. A proper position of the opening 11 has a flexible belt 111, which is formed by a single strip or double strips. A lower edge of the flexible belt 111 of the bag body 1 is installed with the exhausting valve 2. The exhausting valve 2 includes a valve body 21, an exhausting unit 22, a valve gate 23 and an elastomer 24.

Figure 2:
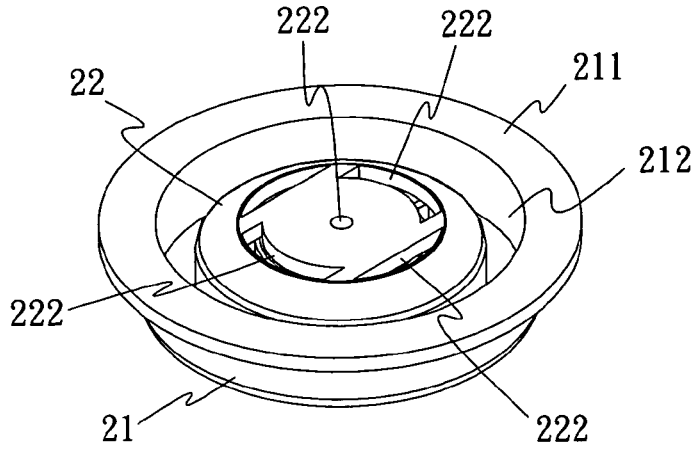
FIG. 2 is an upper perspective view of the exhausting valve of the present invention.
Figure 3:
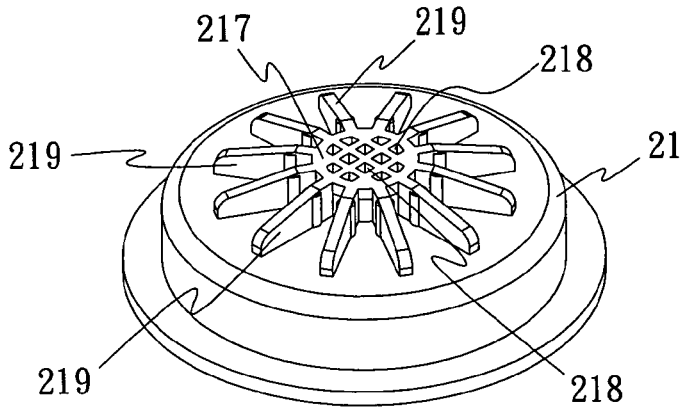
FIG. 3 is a bottom perspective view of the exhausting valve of the present invention.
Figure 4:
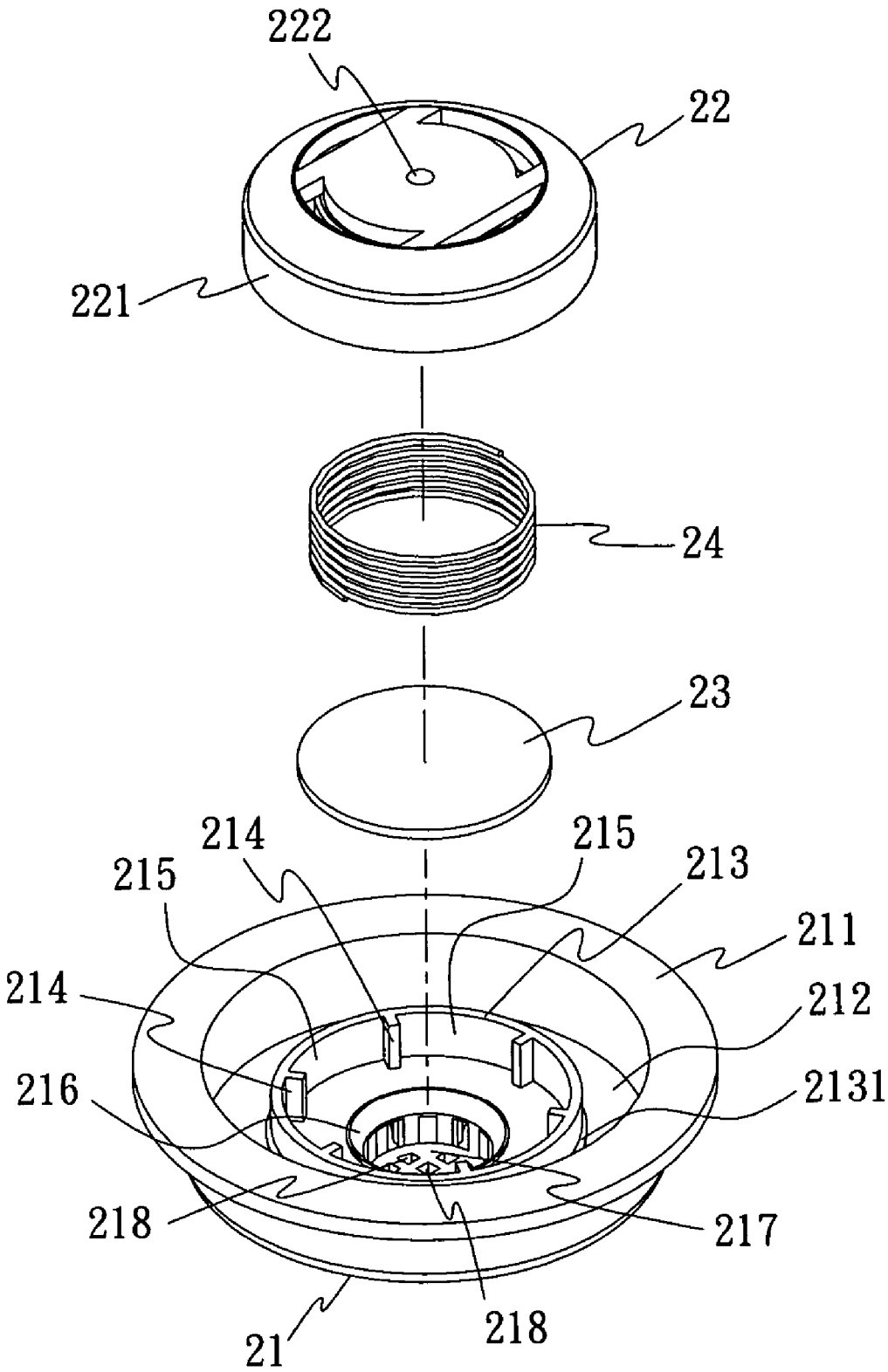
FIG. 4 is a decomposed perspective view of the exhausting valve of the present invention.

Referring to FIGS. 2 to 4, the valve body 21 is made of plastics and is a round disk, a rectangular disk or disks of other shapes. An end portion of the valve body 21 has a plane combining surface 211. A center of the combining surface 211 has a receiving chamber 212. A bottom of the receiving chamber 212 is vertically installed with a hollow ring 213. An inner annular surface of the ring 213 has a plurality of ribs 214. Each two adjacent ribs 214 is formed as an air guide channel 215. The inner bottom of the hollow ring 213 is installed through the other side of valve body 21 of the firs exhausting holes 216 so as to form the surface 211 to be pasted on the valve body 21 of the bag body 1. Wherein a spacer 217 is installed on the bottom of the first exhausting hole 216. The spacer 217 has a plurality of small holes 218 so as to prevent from leaking out contents of the bag body 1. Besides, the periphery of spacer 217 on the surface of the valve body 21 has a plurality of raised ribs 219 so as to prevent that the small holes 218 is sealed by the bag body 1 and to make sure the well exhausting function of the bag body 1. The periphery of hollow ring 213 has a button unit 2131, which is used to install with the exhausting unit 22.

Figure 5:
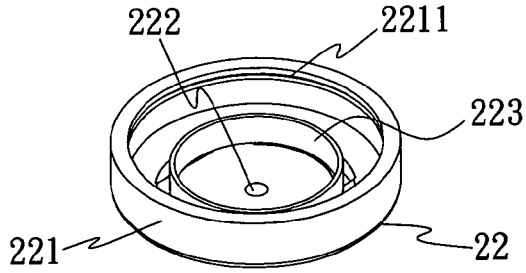
FIG. 5 is a bottom perspective view of the exhausting unit of the present invention.

Referring to FIG. 2 and FIG. 5, the exhausting unit 22 is made of plastics by a shaping whole and then is formed the shape to correspond with the shape of hollow ring 213.

Figure 6:
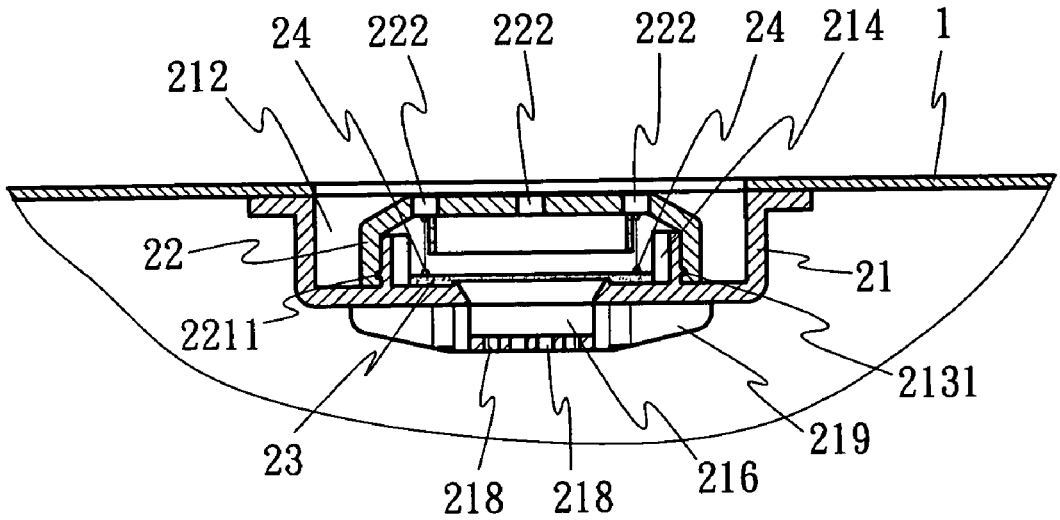
FIG. 6 is an assembled cross-sectional view of the exhausting valve with the bag body.

Referring to FIG. 6, a round ⊓shape casing has a ring wall 221 on thereof periphery, wherein the round ⊓shape casing is installed inner the receiving chamber 212 of the valve body 21 and cover on the end of the hollow ring 213. The proper position of the end of the exhausting unit 22 has a plurality of the second exhausting holes 222, which are interlinked through to the first exhausting hole 216. In addition, on the top end of the exhausting unit 22 has a fixed position ring 223, which is used to install with elastomer 24. The inner side of the ring wall 221 has a ring button grave 2211 used to lock with the button unit 2131 and then the exhausting unit 22 is fixed with hollow ring 213.

Referring to FIG. 4 and FIG. 6, the valve gate 23 is made of plastics, rubber or another materials to form a slice of soft flat piece. The valve gate 23 is placed horizontally on the inner hollow ring 213 of the valve body 21, which is limited by a plurality of the ribs 214 so as to be available to be up or down status, by which the upper end of the first exhausting hole 216 on the inner bottom of the hollow ring 213 can be covered.

Referring to FIG. 4 and FIG. 6, the elastomer 24 is a kind of spiral spring, which is sleeved on the outside wall of the fixed position ring 223 of the exhausting unit 22. The upper and lower ends of the spiral spring are pushed against the exhausting unit 22 and valve gate 23 separately so as to use the elasticity of the elastomer 24 to enable the valve gate 23 to be covered tightly on the upper end of the periphery of the exhausting hole 216 continuously.

The exhausting valve 2 of the present invention is glued to the inner side of the bag body 1 by the surface 211, which is concealed inner the bag body 1. Referring to FIG. 6, only the upper edge surface of the exhausting unit 22 can be seen when looking an appearance of the bag body 1, all the other elements of the valve body 21 are concealed inner the bag body 1. The exhausting valve 2 has the function of exhausting residual air for the sealed bag body 1.

Figure 7:
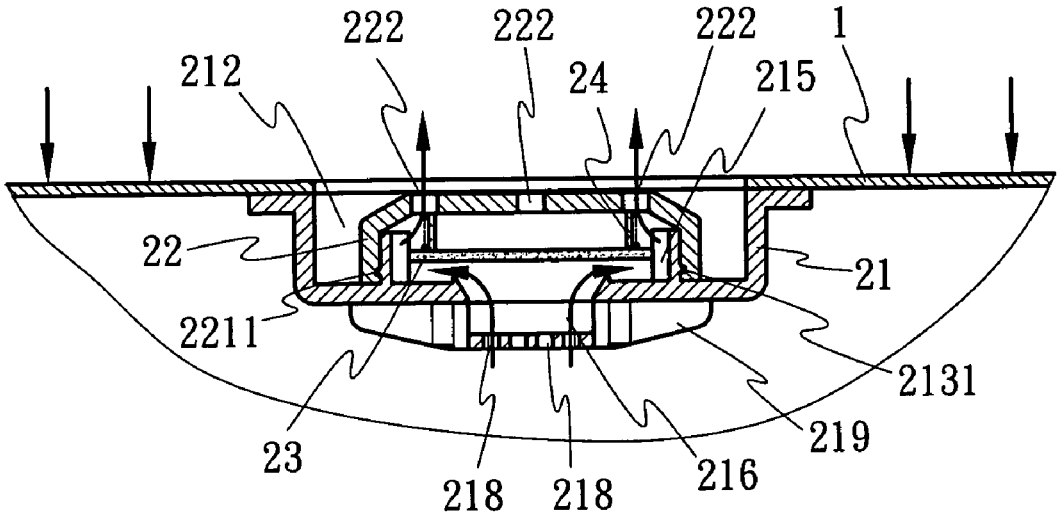
FIG. 7 is illustrated to a status of exhausting air of the present invention.
Figure 8:
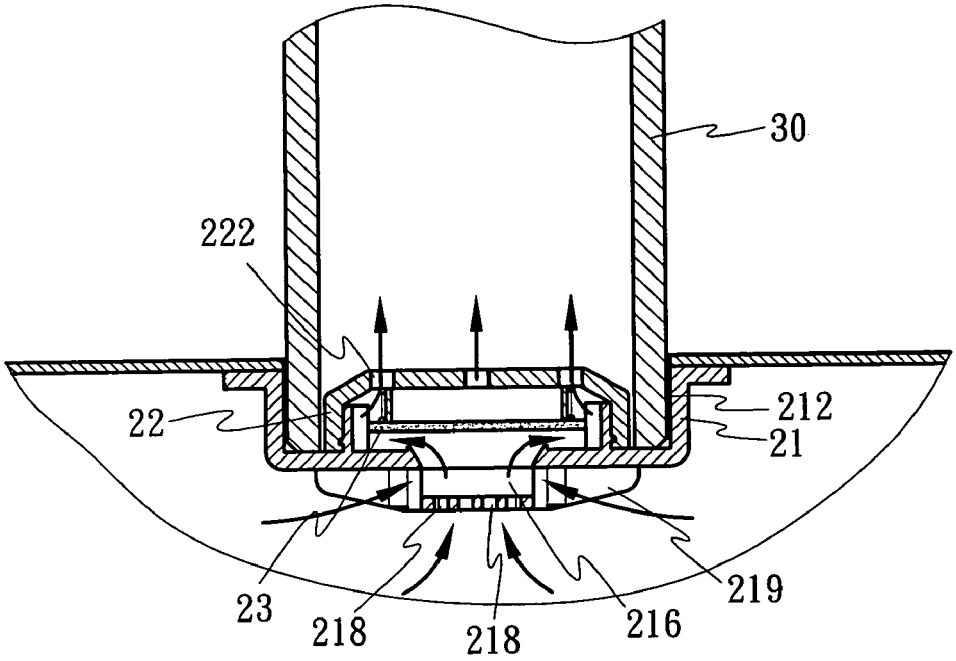
FIG. 8 is illustrated to a status of exhausting air using an inhaling device of the present invention.
Figure 9:
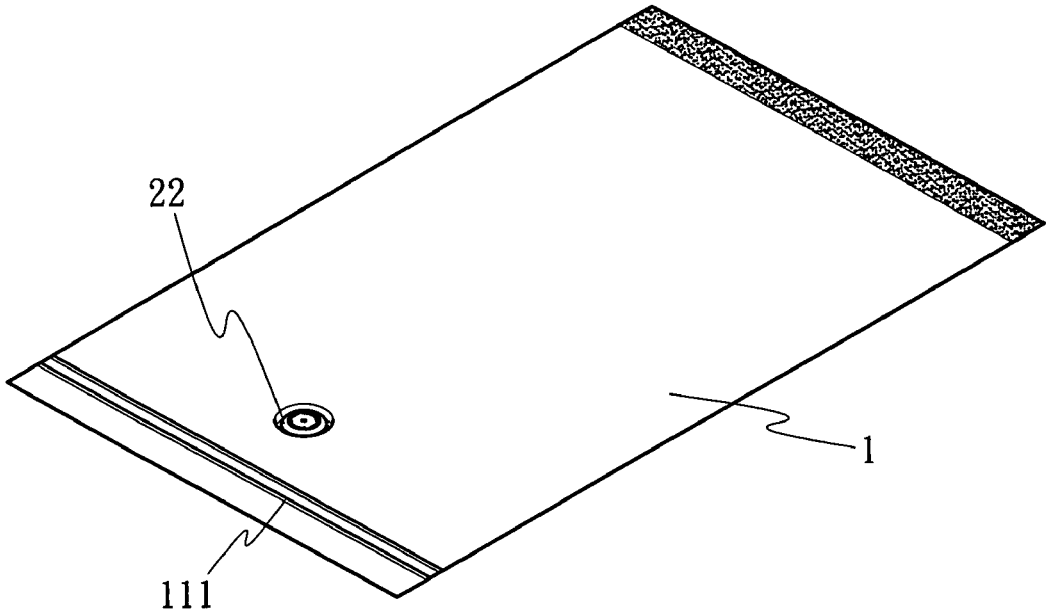
FIG. 9 is illustrated one embodiment of the present invention.
Figure 10:
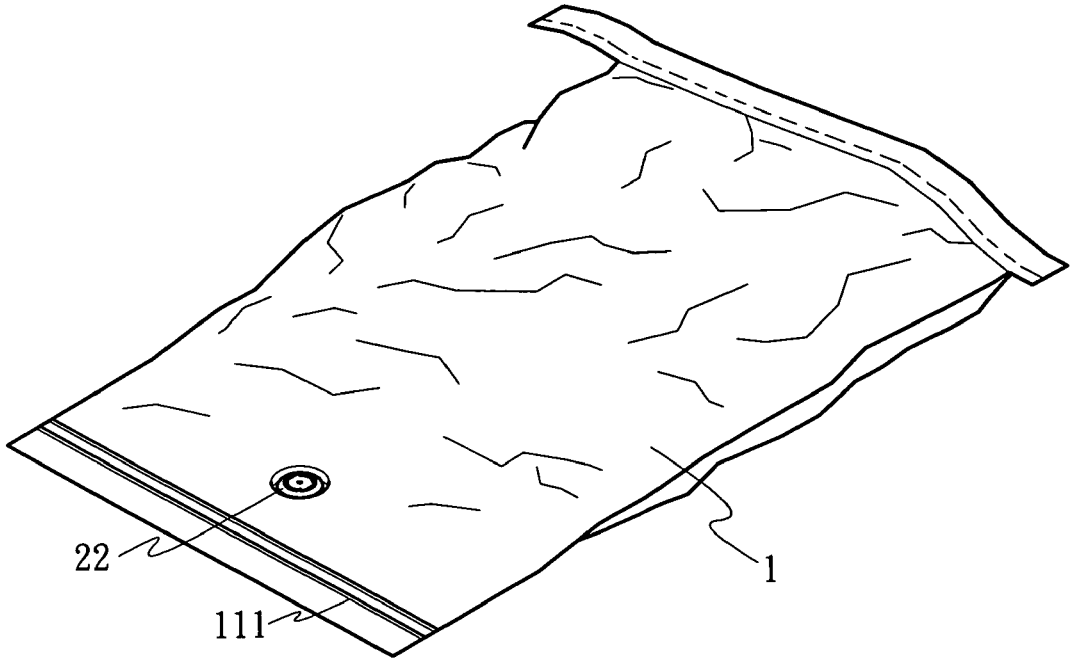
FIG. 10 is illustrated another embodiment of the present invention.
Figure 11:
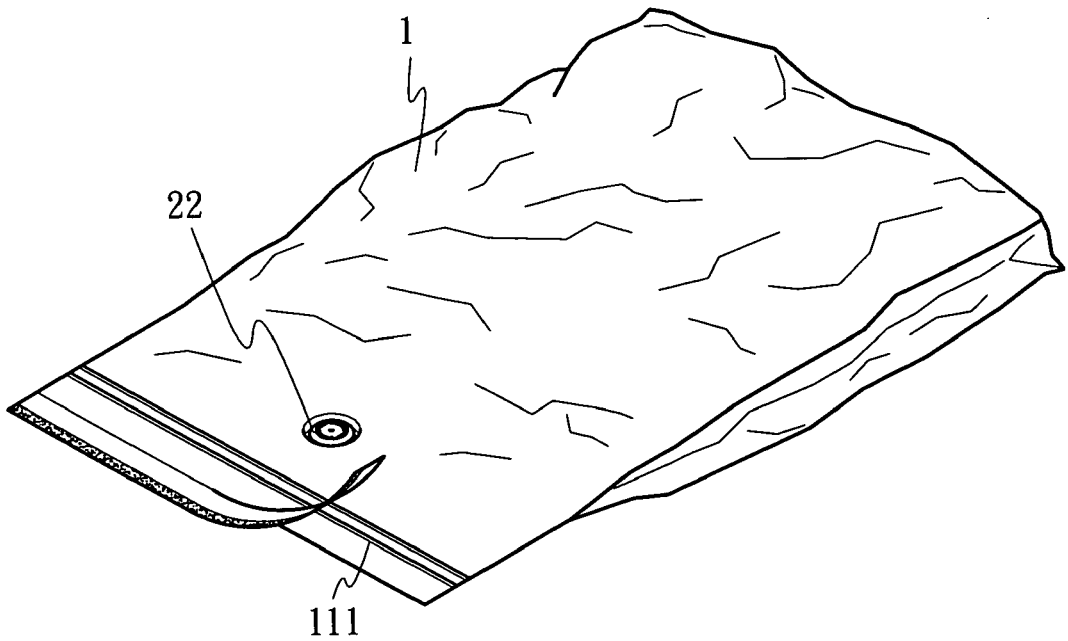
FIG. 11 is illustrated to seal off the bag body for the first time use of the present invention.

For using the moisture-proof sealing bag, the flexible belt 111 of the bag body 1 should be sealed after contenting the material into the moisture-proof sealing bag, or the opening on the upper of the flexible belt 111 should be glued. Referring to FIG. 11, when the moisture-proof sealing bag is opened by a user, the flexible belt 111 of the bag body 1 can be used simply and effectively to seal the bag without worrying about leaking the smell of the contents in the bag out. However, residual air may be stayed in the bag body 1 after several repeats of opening and sealing flexible belt 111 of the bag. The residual air contains with water, which is possible to wet or deteriorate the contents in the bag. Therefore, the residual air can be exhausted through the first exhausting hole 216 pushing up the valve gate 23, and then the residual air passes through air guide channel 215 to the second exhausting holes 222 of the exhausting unit 22 out of the bag, referring to FIG. 7.

In another alternative way, an inhaling tube 30 of an air induction device (such as vacuum cleaner) can be established in the receiving chamber 212 of the valve body 21 and use the attraction of the air induction device to rise and open the valve gate 23. The residual air of the bag body 1 is inhaled and then the chamber the bag body 1 is vacuumed so as to prevent from wetting and deteriorating the contents in the bag body 1 as well as downsizing the volume of the bag body 1.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A moisture-proof sealing bag, comprising:

a bag body defining a chamber capable of containing residual air and having an inner side and an opening;

a position of the opening having a flexible belt, which is formed by a single strip or double strips;

an exhausting valve having an upper end and a lower edge of the flexible belt of the bag body being installed with the exhausting valve;

the exhausting valve including a valve body having a surface, an open side and first and second exhausting holes and wherein the first exhausting holes have an upper end of the periphery thereof, an exhausting unit, a valve gate and an elastomer;

an end portion of the valve body having a plane combining surface; a center of the combining surface having a receiving chamber; a bottom of the receiving chamber being vertically installed with a hollow ring having an inner bottom;

the inner bottom of the hollow ring being installed through the open side of the valve body of the first exhausting holes;

the exhausting unit being installed inner the receiving chamber of the valve body and covering on the end of the hollow ring;

the proper position of the end of the exhausting unit having second exhausting holes, which are interlinked through to the first exhausting hole;

the valve gate being placed on the inner hollow ring, which is available to be up or down status and can cover the upper ends of the first exhausting holes;

the elastomer being established between exhausting unit and valve gate by using the elasticity of the elastomer to enable the valve gate to be covered tightly on the upper ends of the exhausting holes continuously;

the surface of the valve body being glued to the exhausting valve of the inner side of the bag body;

by use of the surface of the valve body being glued to the exhausting valve of the inner side of the bag body and the opening of the bag body being sealed, and any residual air within the bag body being exhausted from the bag body;

the chamber of the bag body being vacuumed so as to prevent from moisture and deteriorating the contents in the bag body as well as downsizing the volume of the bag body.

2. The moisture-proof sealing bag as claimed in claim 1, wherein the bag body is made at least one of Nylon, polyeater, polyethylence, aluminum, or paper, and has a single layer or a plurality of layers.

3. The moisture-proof sealing bag as claimed in claim 1, wherein the valve body is made of plastics and has a shape selected from one of a round disk, a rectangular disk or disks of other shapes.

4. The moisture-proof sealing bag as claimed in claim 1, wherein the outer periphery of the hollow ring of the exhausting valve of the valve body has a button unit; the exhausting unit defines a round shaped casing with a ring wall having an inner side on the periphery; and the inner side of the ring wall has a ring button grave used to lock with the button unit and then the exhausting unit is fixed with the hollow ring.

5. The moisture-proof sealing bag as claimed in claim 1, wherein on the upper end of the exhausting valve of the exhausting unit has a fixed position ring; the exhausting unit is a spiral spring, which is sleeved on the fixed position ring; the upper and lower ends of the spiral spring are pushed against the exhausting unit and valve gate separately.

6. The moisture-proof sealing bag as claimed in claim 1, wherein an inner annular surface of the ring has a plurality of ribs; each two adjacent ribs is formed as an air guide channel; the valve gate is limited by a plurality of the ribs so as to be available to be up or down status.

7. The moisture-proof sealing bag as claimed in claim 1, which includes a first exhausting hole having a bottom wherein a spacer is installed on the bottom of the first exhausting hole; the spacer has a plurality of small holes; the periphery of the spacer on the surface of the valve body has a plurality of raised ribs.

* * * * *